US008904925B2

(12) United States Patent
Haberstroh et al.

(10) Patent No.: US 8,904,925 B2
(45) Date of Patent: Dec. 9, 2014

(54) MODULAR STRAPPING HEAD WITH HEAT BLADE

(75) Inventors: James A. Haberstroh, Vernon Hills, IL (US); Christopher S. Krohn, Grayslake, IL (US)

(73) Assignee: Illinois Tool Works Inc., Glenview, IL (US)

( * ) Notice: Subject to any disclaimer, the term of this patent is extended or adjusted under 35 U.S.C. 154(b) by 203 days.

(21) Appl. No.: 13/092,549

(22) Filed: Apr. 22, 2011

(65) Prior Publication Data

US 2011/0308404 A1 Dec. 22, 2011

Related U.S. Application Data

(60) Provisional application No. 61/357,348, filed on Jun. 22, 2010.

(51) Int. Cl.

| | |
|---|---|
| ***B65B 13/32*** | (2006.01) |
| ***B65B 13/06*** | (2006.01) |
| ***B65B 13/18*** | (2006.01) |

(52) U.S. Cl.

CPC ..... *B65B 13/18* (2013.01); *B65B 13/32* (2013.01); *B65B 13/06* (2013.01)

USPC ..... 100/33 R; 100/26; 100/29

(58) Field of Classification Search

USPC ..... 100/26, 29, 30, 32, 33 P, 33 R, 33 PB; 53/589

See application file for complete search history.

(56) References Cited

U.S. PATENT DOCUMENTS

| | | | | |
|---|---|---|---|---|
| 4,005,647 | A * | 2/1977 | Goodley et al. | 100/4 |
| 4,209,958 | A | 7/1980 | Bailey | |
| 4,288,270 | A | 9/1981 | Mossell et al. | |
| 4,661,185 | A | 4/1987 | Kobiella | |
| 6,532,722 | B2 | 3/2003 | Gerhart et al. | |
| 6,584,892 | B2 * | 7/2003 | Flaum et al. | 100/26 |
| 6,745,677 | B2 | 6/2004 | Pearson et al. | |
| 6,755,123 | B2 | 6/2004 | Flaum et al. | |
| 6,945,164 | B2 | 9/2005 | Kobiella et al. | |
| 7,681,496 | B2 | 3/2010 | Takidis et al. | |
| 2002/0134252 | A1 * | 9/2002 | Helland et al. | 100/26 |
| 2004/0098955 | A1 * | 5/2004 | Bobren et al. | 53/589 |
| 2004/0216432 | A1 * | 11/2004 | Lopez | 53/589 |
| 2008/0289516 | A1 * | 11/2008 | Takidis et al. | 100/8 |

FOREIGN PATENT DOCUMENTS

| | | | |
|---|---|---|---|
| EP | 1275586 | A1 | 1/2003 |
| WO | 2007074372 | A2 | 7/2007 |

OTHER PUBLICATIONS

International Search Report and the Written Opinion of the International Searching Authority issued in connection with PCT/US2011/041225 on Nov. 2, 2011.

Communication pursuant to Article 94(3) EPC for EP 11798745.3 dated Apr. 22, 2013.

* cited by examiner

*Primary Examiner* — Jimmy T Nguyen
*Assistant Examiner* — Chwen-Wei Su
(74) *Attorney, Agent, or Firm* — Levenfeld Pearlstein, LLC

(57) ABSTRACT

A modular strapping head assembly includes a body, a weld head assembly, a drive motor configured to control the weld head assembly to grip and seal strapping material, a transformer assembly, and a single power interface configured to direct power from a source to the drive motor and the transformer assembly. The transformer assembly is configured to supply current to the weld head assembly and the weld head assembly is configured to seal a lagging end of the strapping material and a leading end of the strapping material together. Each of the transformer assembly, the drive motor, the weld head assembly, and the power interface are mounted to the body and removable from the strapping machine as an integral unit.

5 Claims, 3 Drawing Sheets

MODULAR STRAPPING HEAD WITH HEAT BLADE

CROSS REFERENCE TO RELATED APPLICATIONS

This application claims the benefit of U.S. Provisional Application No. 61/357,348, filed Jun. 22, 2010.

FIELD OF THE DISCLOSURE

The present disclosure is directed to a modular strapping head assembly with a heated weld blade that facilitates rapid mounting to and removal from a strapping machine for maintenance, repair, and/or replacement.

BACKGROUND

Strapping machines or strappers are in widespread use for securing bands of strap, such as plastic strapping material, around loads. One type of known strapper includes a strapping head and a drive mechanism mounted within a frame. A chute is mounted to the frame through which the strapping material is fed.

In one example, the chute is mounted proximate a work surface and the strapping head is mounted below the work surface to a horizontal portion of the chute. The strapping head is generally fixedly mounted to the strapper using fasteners, such as screws, nuts, bolts, and the like. The drive mechanism is also mounted below the work surface proximate the strapping head. In the present example, the drive mechanism urges or feeds strapping material through the strapping head and into and around the chute until the strapping material returns to the strapping head to form a strap loop around the load. After the strap loop has been formed, the drive mechanism tensions the strapping material about the load and overlapping ends of strap are secured to create a sealed, tensioned loop around the load.

In the present example, the strapping head includes a gripping assembly that grips the strap during a strapping operation and a cutting assembly that cuts the strap from a source or supply of the strapping material. In addition, the strapping head may include a sealing or weld assembly to seal the overlapping strap ends together. One example of the weld assembly includes a weld blade fixed to the strapping head that is heated or energized by an electric current flow. The weld assembly seals the overlapping strap ends together by drawing the heated weld blade between the strap ends to at least partially melt the ends and pressing the heated, melted ends together to form a weld or joint. In the present example, a transformer, which provides the current flow to the weld blade, is housed as a separate component from the strapping head and is hardwired into the strapping machine.

In order to access the strapping head mounted to the strapper, a multitude of fasteners, such as screws and bolts, must be removed. Accessing the strapping head for maintenance or repair can be time consuming and burdensome, in particular, because portions of the strapping head, such as the weld blade, may require relatively frequent inspection and servicing. Consequently, such servicing of the strapping head can lead to substantial downtime as the entire strapping machine is taken out of service for the duration of the work. In addition, skilled technicians with appropriate tools are generally required to tend to the machine during the entirety of the maintenance or repair.

Accordingly, there exists a need for a modular strapping head assembly with a heat knife that eliminates drawbacks encountered with known strapping heads. Such a modular strapping head assembly may be readily removed from and installed into a strapper as an integrated unit to minimize disassembly of the strapping machine and any downtime thereof. Further, such a modular strapping head assembly is readily installed and removed with minimal or no tools.

BRIEF SUMMARY

Various embodiments of the present disclosure provide a modular strapping head assembly for use with a strapping machine of the type for feeding a strapping material around a load in which the strapping material, having a lagging end and a leading end, is positioned, tensioned, and sealed onto itself in a loop around the load. The modular strapping head assembly includes a body, a weld head assembly, a drive motor configured to control the weld head assembly to grip and seal the strapping material, a transformer assembly, and a single power interface configured to direct power from a source to the drive motor and the transformer assembly. The transformer assembly is configured to supply current to the weld head assembly and the weld head assembly is configured to seal the lagging end of the strapping material and the leading end of the strapping material together. Each of the transformer assembly, the drive motor, the weld head assembly, and the power interface are mounted to the body and removable from the strapping machine as an integral unit.

Still other embodiments of the present disclosure provide a strapping machine of the type for feeding a strapping material around a load in which the strapping material, having a lagging end and a leading end, is positioned, tensioned, and sealed onto itself in a loop around the load. The strapping machine includes a strap chute, a strap dispenser for feeding the strapping material through the chute, and a modular strapping head assembly positioned in a path of the strap chute. The modular strapping head assembly further includes a body, a weld head assembly, a drive motor configured to control the weld head assembly to grip and seal the strapping material, a transformer assembly, and a single power interface configured to direct power from a source to the drive motor and the transformer assembly. The transformer assembly is configured to supply current to the weld head assembly and the weld head assembly is configured to seal the lagging end of the strapping material and the leading end of the strapping material together. Further, each of the transformer assembly, the drive motor, the weld head assembly, and the power interface are mounted to the body and removable from the strapping machine as an integral unit.

In this manner, the present disclosure provides a strapping head assembly that is removable and replaceable as a unit independent of other components of a strapping machine. Further, the strapping head assembly is configured to facilitate quick and efficient mounting and removal of the strapping head assembly in and from the strapping machine.

Other objects, features, and advantages of the disclosure will be apparent from the following description, taken in conjunction with the accompanying sheets of drawings, wherein like numerals refer to like parts, elements, components, steps, and processes.

Figure 2:
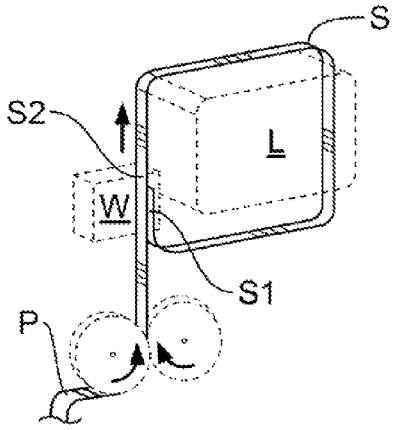
FIG. 2 is a schematic illustration of the strapping machine, illustrating a strap being fed around a load.

Skilled artisans will appreciate that elements in the figures are illustrated for simplicity and clarity and have not necessarily been drawn to scale. Also, common, but well-understood elements that are useful or necessary in a commercially feasible embodiment are not often depicted in order to facilitate a less obstructed view of these various embodiments of the present disclosure.

DETAILED DESCRIPTION

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated. The words "a" or "an" are to be taken to include both the singular and the plural. Conversely, any reference to plural items shall, where appropriate, include the singular.

Figure 1:
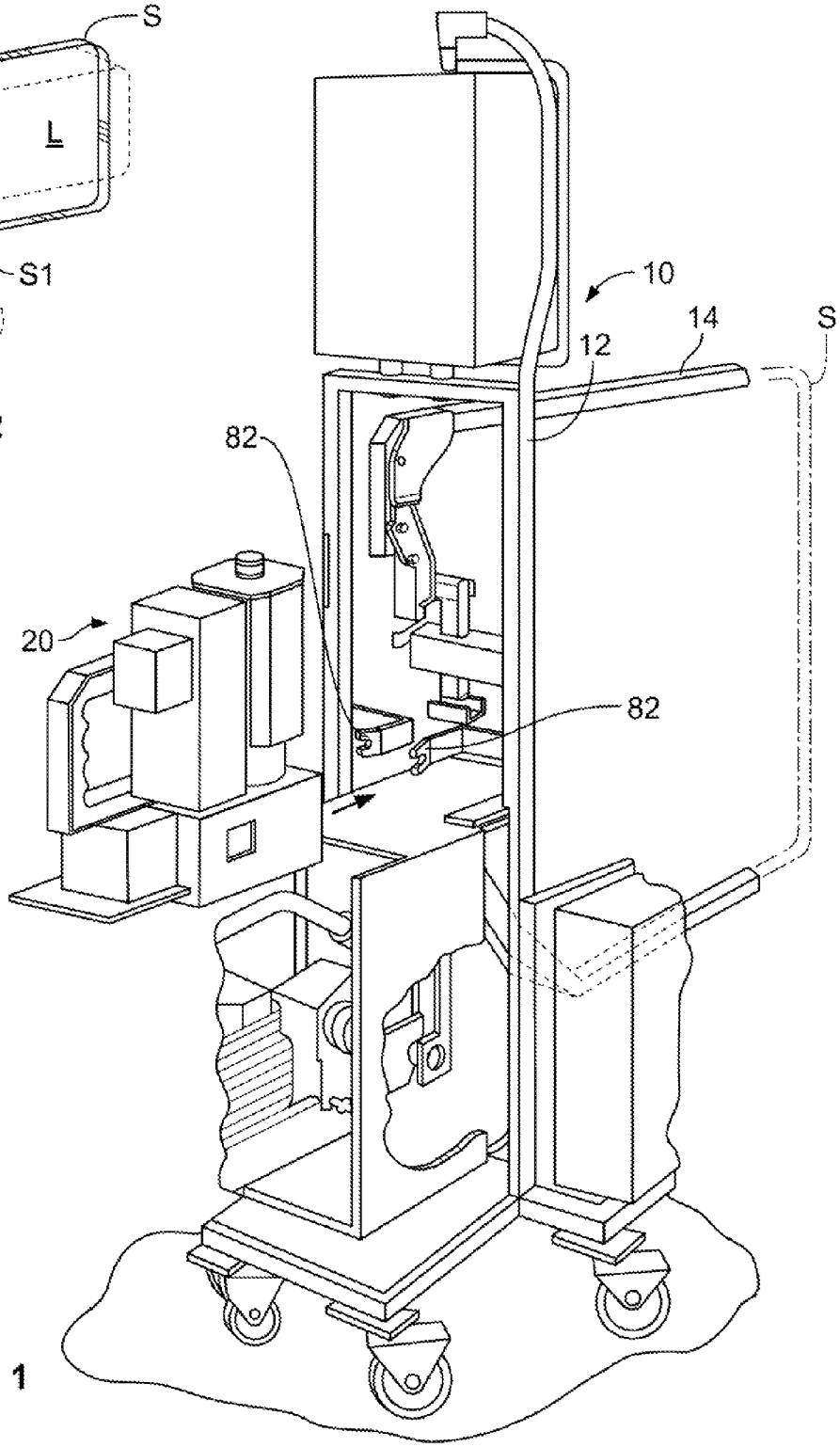
FIG. 1 is a perspective view of a strapping machine in accordance with an embodiment of the present disclosure.

Referring to FIGS. 1 and 2, there is shown a strapping machine 10 having a frame 12 and a strap chute 14, which defines a strap path about which a strap S is conveyed during a strapping operation. The strapping machine 10 further includes a modular strapping head assembly 20 with a weld head W positioned in a path of the strap chute 14. In the present example, a side seal type strapping machine 10 and strapping head assembly 20 are shown. However, it will be appreciated by those skilled in the art that the strapping head assembly may be configured for use with bottom sealing strapping machines, as well as other types of strapping machines.

Generally, in use, the strap S is fed or dispensed from a strap dispenser or supply P into the strapping machine 10. The strap S is conveyed through the strapping head assembly 20 into the chute 14. The strap S traverses through the chute 14 and returns to the strapping head assembly 20. The weld head W grips a free end of the strap S upon return to the strapping head assembly 20. The strap S can then be tensioned around a load L disposed within a loop of strap formed by the chute 14, the strap cut, and the strap welded or otherwise sealed to itself. Additional details of a strapping machine and weld or strapping head are disclosed in Pearson et al. U.S. Pat. No. 6,745,677 and Kobiella et al. U.S. Pat. No. 6,945,164, each of which is hereby incorporated by reference in its entirety.

Figure 3:
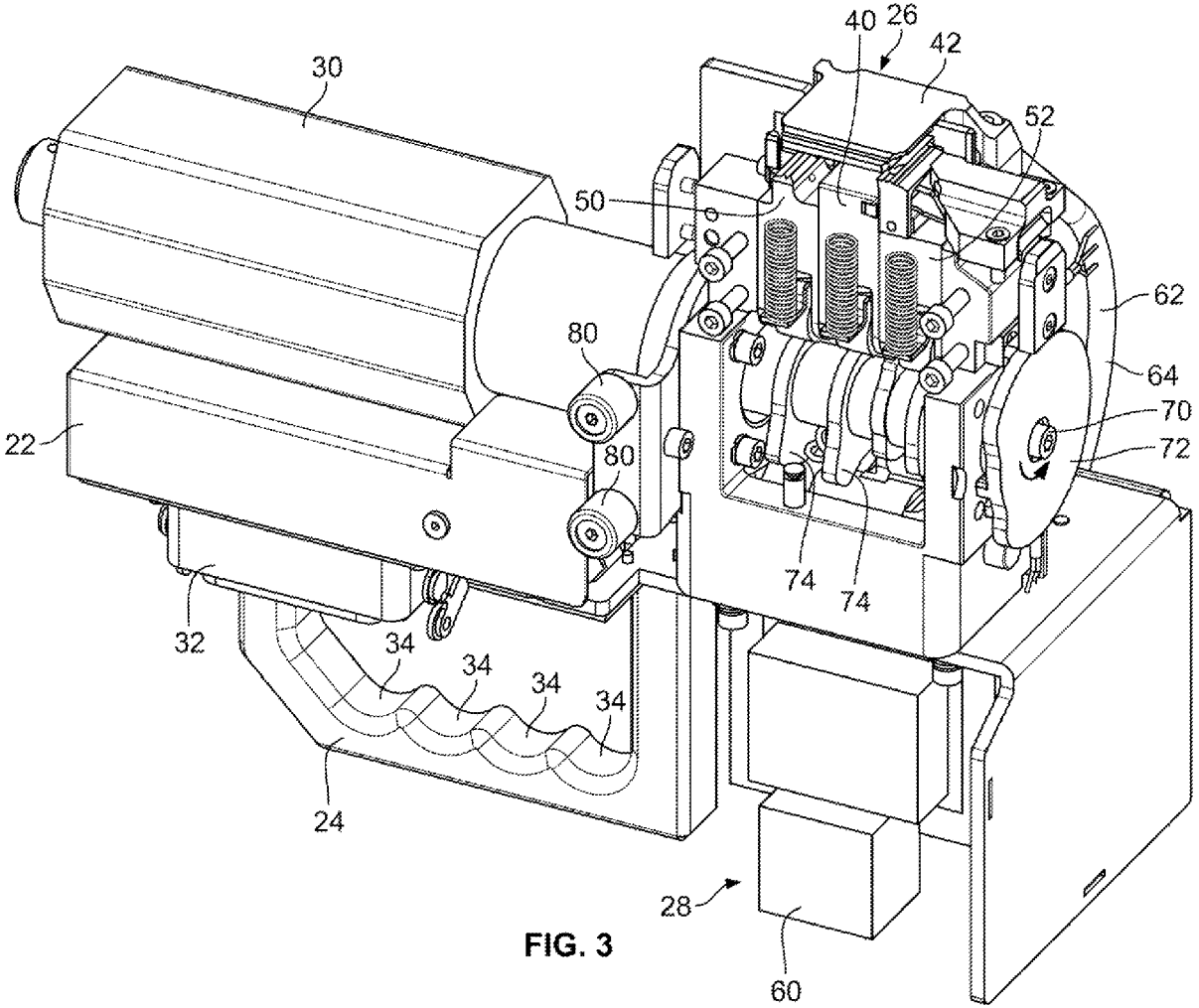
FIG. 3 is a perspective view generally of a first side of a strapping head assembly in accordance with an embodiment of the present disclosure, wherein the strapping head assembly may be used with the strapping machine of FIG. 1.
Figure 4:
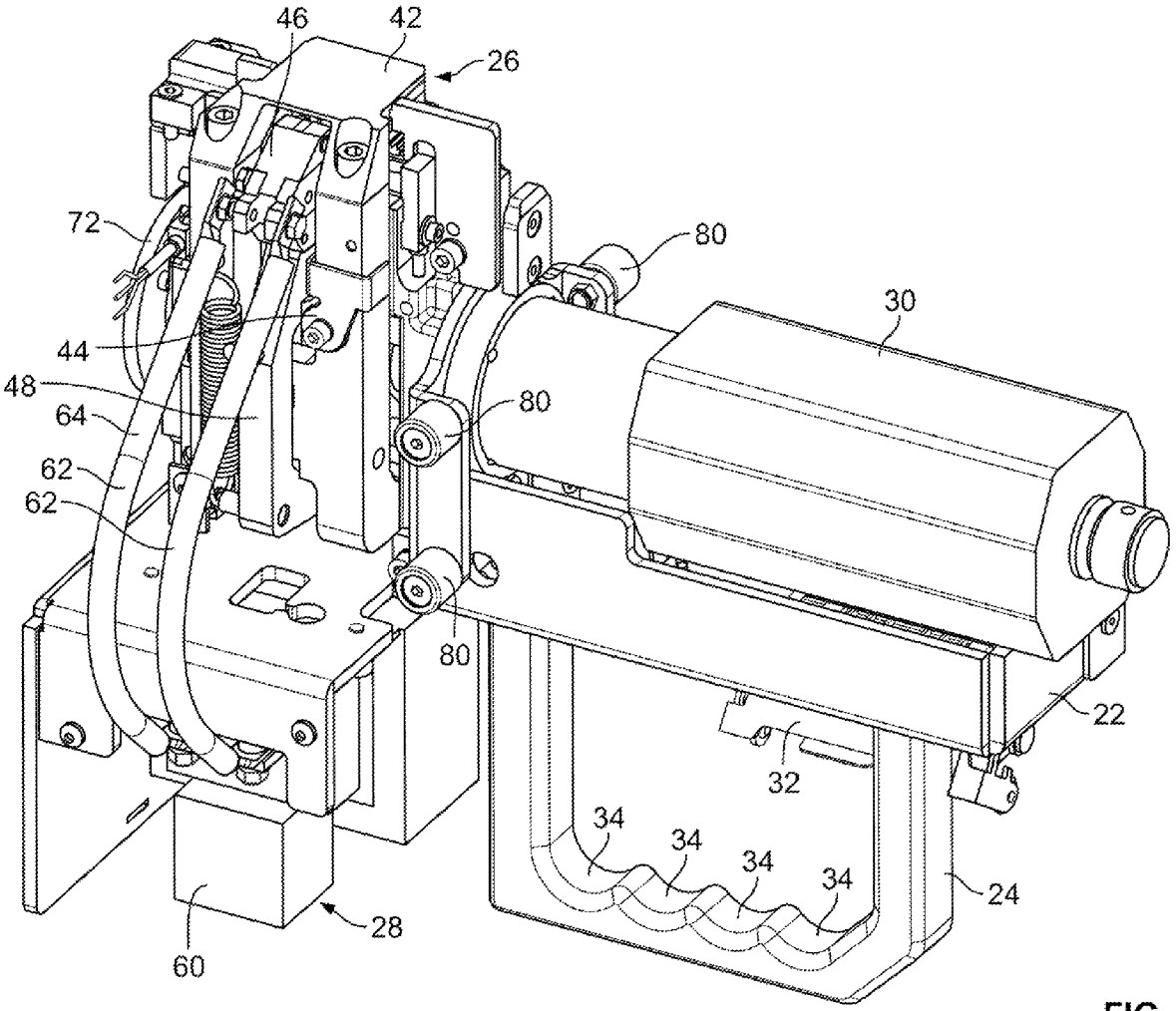
FIG. 4 is a perspective view generally of a second side of the strapping head assembly of FIG. 3.

Turning now more particularly to FIGS. 3 and 4, the strapping head assembly 20 in accordance with the present embodiment includes a body 22 having a handle 24, a sealing or weld head assembly 26, a transformer assembly 28, a motor 30, and a power interface 32. In the present example, the handle 24, sealing or weld head assembly 26, transformer assembly 28, motor 30, and power interface 32 are all mounted to or integral with the body 22.

The handle 24 is coupled to the body 22 of the modular strapping head assembly 20 and is configured to facilitate quick and efficient mounting and removal of the modular strapping head assembly 20 to and from the strapping machine 10. The handle 24 is formed, in the example shown in the figures, as a one-handed type handle, having finger depressions 34 to conform to a user's hand. In the present example, the handle 24 is integral with the body 22 such that when a user lifts the handle 24, the entire modular strapping head assembly 20 is lifted as one unit. The handle 24 allows the user to snap fit or otherwise mount the strapping head assembly 20 into position within the frame 12 of the strapping machine 10. The handle 24 also enables the user to grip the handle 24 with one hand and unsnap or otherwise remove or lift the entire strapping head assembly 20 from the strapping machine 10 in one easy motion.

The sealing or weld head assembly 26 includes a platen 40, an anvil 42, an anvil pivot 44, a weld blade 46, a weld blade pivot 48, a loop grip 50, and an end grip 52. As described above and with further reference to FIGS. 2-4, generally, in use, the strap S is fed through the strapping head assembly 20 into the chute 14 with a leading strap end S1 that returns to the strapping head assembly. The strap end S1 is gripped between the end grip S2 and the anvil 42. The strap S can then be retracted and tensioned about the load L. Thereafter, the loop grip 50 is actuated to grip another portion of the strap S, which in the present example is a portion of a lagging strap end S2 of the strap S fed from the strap supply P. The weld blade 46 is heated to melt overlapping portions of the strap ends S1, S2 and the platen 40 is actuated to press the heated, melted overlapping strap ends together against the anvil 42 to create a sealed, tensioned loop around the load L. Another example of a sealing or weld head assembly is disclosed in Gerhart et al. U.S. Pat. No. 6,532,722, which is hereby incorporated by reference in its entirety.

The transformer assembly 28 including a transformer 60 and associated wires 62 is mounted to the body 22 and integrated with the sealing head assembly 20. The wires 62 and the transformer assembly 28 also have an insulation system 64 associated therewith. The transformer 60 supplies high current to the weld blade 46 to heat the blade and produce a heat seal between the overlapping strap ends S1, S2. The transformer 60 and/or the wires 62, which travel from the transformer to the weld blade 46, are wrapped in the insulation system 64 to shield other components of the strapping head assembly 20 from excessive exposure to heat and to ensure efficient transfer of energy from the transformer 60 to the weld-blade 46.

The motor 30 can be, for example, a brushless, direct current-type indexing motor. The motor 30 controls the angular position of a camshaft 70 and cams 72, 74, which are disposed in or near the weld head assembly 26. The cams 72, 74 are actuated by the motor 30 and configured to move the end grip 52, loop grip 50, platen 40, anvil 42, and weld blade 46 in a sequence that grips and seals the strap, as discussed generally hereinabove. In one example, the cams 72, 74 are also configured to actuate a cutter (not shown) to sever the strap S, as would be apparent to one of ordinary skill in the art.

The power interface 32 provides a single power input coupling for the strapping head assembly 20 and directs power to components of the strapping head assembly, such as the motor 30 and the transformer assembly 28. The power interface 32 is compact and provides a pre-wired interface that can link to a corresponding interface or port in the frame 12, thereby eliminating the need for complex wiring or installation of the strapping head assembly 20 to the strapping machine 10. The power interface 32 may also serve as a coupling for data and/or control commands to the modular strapping head assembly 20.

As discussed, the present strapping machine 10 has a modular arrangement in which the modular strapping head 20 is removably mounted to the frame 12. To ensure that the modular strapping head 20 is properly oriented, aligned, and mounted within the frame 12, aligning members 80 may be present which snap fit into corresponding notches 82 in the frame 12 or otherwise engage with portions of the strapping machine 10. In addition, the power interface 32 further facilitates the proper alignment of the strapping head assembly 20 within the strapping machine 10. The modular strapping head 20 is positioned in the frame 12 such that the power interface 32 of the modular strapping head assembly 20 is fitted onto the corresponding electrical interface (not shown) in the frame 12 of the strapping machine 10 while the aligning members 80 snap fit into their corresponding notches 82.

Various advantages of the present strapping head assembly 20 will be appreciated by those skilled in the art. For example, the strapping head assembly 20 may include fewer moving parts than previous strapping heads with weld blades or heat knives and, thus, may be more cost-effective to maintain because the reduction of moving parts generally results in a reduction in downtime for maintenance and cleaning. In addition, the strapping head assembly 20 is easily mounted to and removed from a strapper as a unit, which significantly decreases installation and replacement times. The strapping head assembly 20 is also readily mounted to and removed from a strapper by hand and without requiring any other tools, such as wrenches, screw drivers, pliers, and the like.

Other embodiments include all of the various combinations of individual features of each of the embodiments or examples described herein.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A modular strapping head assembly for use with a strapping machine of the type for feeding a polymeric strapping material around a load in which the strapping material, having a lagging end and a leading end, is positioned, tensioned, and heat sealed onto itself in a loop around the load, the modular strapping head assembly comprising:

a body;

a weld head assembly, the weld head assembly including a platen, an anvil, a weld blade, a loop grip, and an end grip, the weld head including a plurality of cams coupled to the weld head assembly, wherein the drive motor is configured to control an angular position of the plurality of cams to move the end grip, the loop grip, the platen, and the weld blade in a sequence that grips and heat seals the strapping material;

a drive motor configured to control the weld head assembly to grip and seal the strapping material, the drive motor being a direct current, brushless drive motor;

a transformer assembly;

a single power interface configured to direct power from a source to the drive motor and the transformer assembly, the power interface providing a coupling for power and data;

a handle coupled to the body; and aligning members coupled to the body and configured to snap fit into corresponding notches in the strapping machine, the aligning members and the power interface facilitate the proper alignment of the strapping head assembly with the strapping machine, wherein the transformer assembly is configured to supply current to the weld blade to heat the weld blade, and the weld blade is configured to heat the leading end and the lagging end of the strapping material to heat seal the lagging end of the strapping material and the leading end of the strapping material together, wherein each of the transformer assembly, the drive motor, the weld head assembly, and the power interface are mounted to the body and removable from the strapping machine as an integral unit, and wherein the drive motor is configured to control the end grip to grip the leading end of the strapping material, to control the loop grip to grip the lagging end of the strapping material, to control the weld blade to heat the leading end and the lagging end of the strapping material, and to control the platen to press and seal the heated leading and lagging ends together.

2. The modular strapping head assembly of claim 1 wherein the transformer assembly includes a transformer and wires coupled between the transformer and the weld head assembly, and further includes an insulation system associated therewith.

3. A strapping machine of the type for feeding a polymeric strapping material around a load in which the strapping material, having a lagging end and a leading end, is positioned, tensioned, and heat sealed onto itself in a loop around the load, the strapping machine comprising:

a strap chute;

a strap dispenser for feeding the strapping material through the chute;

a modular strapping head assembly positioned in a path of the strap chute, the modular strapping head assembly further comprising a body, a weld head assembly, a direct current brushless drive motor, drive motor configured to control the weld head assembly to grip and heat seal the strapping material, a transformer assembly, and a single power interface configured to direct power from a source to the drive motor and the transformer assembly, the power interface providing a coupling for power and data; and aligning members coupled to the body and configured to snap fit into corresponding notches in the strapping machine, the aligning members and the power interface facilitate proper alignment of the strapping head assembly with the strapping machine, wherein the weld head assembly includes a platen, an anvil, a weld blade, a loop grip, and an end grip, the weld head including a plurality of cams coupled to the weld head assembly, wherein the drive motor is configured to control an angular position of the plurality of cams to move the end grip, the loop grip, the platen, and the weld blade in a sequence that grips and seals the strapping material, wherein the transformer assembly is configured to supply current to the weld blade to heat the weld blade, and the weld blade is configured to heat the leading end and the lagging end of the strapping material to heat seal the lagging end of the strapping material and the leading end of the strapping material together, wherein each of the transformer assembly, the drive motor, the weld head assembly, and the power interface are mounted to the body and removable from the strapping machine as an integral unit, and wherein the drive motor is configured to control the end grip to grip the leading end of the strapping material, to control the loop grip to grip the lagging end of the strapping material, to control the weld blade to heat the leading end and the lagging end of the strapping material, and to control the platen to press and seal the heated leading and lagging ends together.

4. The strapping machine of claim 3 further comprising a handle coupled to the body.

5. The strapping machine of claim 3 wherein the transformer assembly includes a transformer and wires coupled between the transformer and the weld head assembly, and further includes an insulation system associated therewith.

* * * * *